US010631598B2

(12) United States Patent
Chu

(10) Patent No.: US 10,631,598 B2
(45) Date of Patent: Apr. 28, 2020

(54) BUCKLE STRUCTURE

(71) Applicant: Ming-Hui Chu, Taichung (TW)

(72) Inventor: Ming-Hui Chu, Taichung (TW)

( * ) Notice: Subject to any disclaimer, the term of this patent is extended or adjusted under 35 U.S.C. 154(b) by 161 days.

(21) Appl. No.: 15/942,572

(22) Filed: Apr. 2, 2018

(65) Prior Publication Data

US 2018/0289113 A1 Oct. 11, 2018

(30) Foreign Application Priority Data

Apr. 7, 2017 (TW) ..... 106204830

(51) Int. Cl.
*A44B 11/26* (2006.01)
*A44B 11/25* (2006.01)

(52) U.S. Cl.
CPC ..... *A44B 11/266* (2013.01); *A44B 11/2592* (2013.01)

(58) Field of Classification Search
CPC . A44B 11/25; A44B 11/2592; A44B 11/2596; A44B 11/26; A44B 11/263; A44B 11/266
USPC ..... 24/609–617, 625, 628, 629, 630, 633
See application file for complete search history.

(56) References Cited

U.S. PATENT DOCUMENTS 686,165 A * 11/1901 Tamm ..... A41F 3/00 2/334
780,192 A * 1/1905 Jones ..... B61G 1/28 213/90
2,446,951 A * 8/1948 Quilter ..... B64D 17/32 2/334
6,378,466 B1 * 4/2002 Oyster ..... A01K 27/00 119/863
6,553,637 B1 * 4/2003 Chen ..... A44B 11/266 24/614
8,769,783 B2 * 7/2014 Kawaguchi ..... A44B 11/266 24/625
2018/0027929 A1 * 2/2018 Renforth ..... A44B 11/266

* cited by examiner

*Primary Examiner* — William V Gilbert

(57) ABSTRACT

A buckle structure contains a male buckle, two fastening arms, and a resilient sheet. The male buckle includes a first opening, a second opening opposite to the first opening, an external fence, and an accommodation cavity, wherein the external fence has two first orifices. Each of the two fastening arms includes a through hole, an engagement portion, a first abutting face, a second abutting face, and a column rotatably connected with the first orifice and the through hole so that the first abutting face and the second abutting face are located in the accommodation cavity of the male buckle, and the engagement portion of each fastening arm extends out of the first opening of the male buckle. The resilient sheet is formed in a U shape and includes a convex arc face and two contacting segments arranged on two ends of the resilient sheet respectively.

10 Claims, 13 Drawing Sheets

BUCKLE STRUCTURE

FIELD OF THE INVENTION

The present invention relates to a buckle structure which is simplified and is connected easily so as to reduce fabrication cost.

BACKGROUND OF THE INVENTION

A conventional buckle is applicable for a backpack, a protector, clothes, or a belt. For example, the conventional buckle is connected with the two straps of the backpack, the protector, the clothes, or the belt.

The conventional buckle contains a male connection member and a female connection member which are connected with the two straps respectively, wherein the male connection member has two hooks, and the female connection member has a locking orifice defined thereon and coupled with the two hooks of the male connection member. After pressing the two hooks, the male connection member is removed from the female connection member quickly. However, the conventional buckle has defects as follows:

1. The two hooks of the male connection member are removable by way of a telescopic spring or a torsion spring, but the telescopic spring or the torsion spring is accommodated in the male connection member by using a bolt element difficultly.

2. The male connection member and the female connection member have two through holes defined on two ends thereof respectively and configured to connect with the two straps individually. However, the male connection member, the female connection member, the two straps cannot rotate to a desired angle, and the male connection member and the female connection member are fastened troublesomely.

The present invention has arisen to mitigate and/or obviate the afore-described disadvantages.

SUMMARY OF THE INVENTION

The primary aspect of the present invention is to provide a buckle structure which connects the two fastening arms with the body easily.

Further aspect of the present invention is to provide a buckle structure in which the two fastening arms expend in the accommodation cavity of the body, and the resilient sheet is retained by the two first abutting faces and the two second abutting faces securely.

Another aspect of the present invention is to provide a buckle structure in which the male buckle fastens with the female buckle easily.

To obtain the above-mentioned aspects, a buckle structure provided by the present invention contains: a male buckle, two fastening arms, and a resilient sheet.

The male buckle includes a first opening defined on a first end thereof, a second opening formed on a second end of the male buckle opposite to the first opening, an external fence formed on an outer surface of the male buckle, and an accommodation cavity defined between and communicating with the first opening and the second opening. The external fence has two first orifices formed on a top thereof.

The two fastening arms include two through holes formed on two first ends thereof respectively, two engagement portions arranged on two second ends of the two fastening arms individually, two first abutting faces and two second abutting faces which are individually formed on two middle sections of the two fastening arms in a V shape, and two column rotatably connected with the two first orifices and the two through holes individually so that the two first abutting faces and the two second abutting faces are located in the accommodation cavity of the male buckle, the two engagement portions of the two fastening arms extend out of the first opening of the male buckle.

The resilient sheet is formed in a U shape, and the resilient sheet includes a convex arc face and two contacting segments arranged on two ends of the resilient sheet respectively.

When the resilient sheet is accommodated in the accommodation cavity of the male buckle, the two contacting segments are biased against the two first abutting faces of the two fastening arms separately, the convex arc face abuts against the two second abutting faces of the two fastening arms, and the convex arc face faces the second opening of the male buckle.

Preferably, the male buckle is rotatably connected with a first connection member, and the male buckle further includes two second orifices symmetrically arranged on two sides of the external fence respectively, and the first connection member has two first support extensions and two first rotary shafts extending inward from inner walls of the two first support extensions individually, wherein the first connection member is connected with the body by inserting the two first rotary shafts into the two second orifices respectively.

Preferably, the two first orifices of the male buckle are formed proximate to the second opening, and the two second orifices are arranged close to the first opening.

Preferably, the two second orifices of the male buckle are arranged close to the second opening, and the two first orifices are formed proximate to the first opening.

Preferably, the male buckle is extruded from aluminum and is electroplated.

Preferably, the buckle structure further contains a female buckle, and the female buckle includes a first aperture defined on a first end of the female buckle and two second apertures formed on two sides of the female buckle individually and communicating with the first aperture, such that when the male buckle is inserted into the first aperture of the female buckle by ways of the two fastening arms and the two engagement portions engage with the two second apertures individually.

Preferably, a second end of the female buckle away from the first aperture is rotatably connected with a second connection member, and the second connection member is made of plastic material or metal material.

Preferably, the female buckle includes two third apertures defined on two sides thereof respectively and located adjacent to the second end of the female buckle, and the second connection member has two second support extensions and two second rotary shafts extending inward from inner walls of the two second support extensions individually, wherein the second connection member is connected with the female buckle by rotatably inserting the two second rotary shafts in the two third apertures respectively.

Preferably, the female buckle includes two rotatable coupling portions extending outward from the second end thereof away from the first aperture, and the two rotatable coupling portions have two passing apertures defined thereon individually; the second connection member has two second support extensions and two second rotary shafts extending inward from inner walls of the two second support extensions individually, wherein the second connection member is connected with the female buckle by rotatably inserting the two second rotary shafts in the two third apertures respectively.

Preferably, the female buckle includes two hooks extending inward from the second end thereof respectively, and the two hooks have two shoulders formed on inner walls of the two hooks individually; the second connection member has two rings formed on two ends thereof individually and configured to hook with the two hooks of the female buckle respectively, wherein the two shoulders stop the two rings respectively.

DETAILED DESCRIPTION OF THE FIRST EMBODIMENTS

Figure 1:
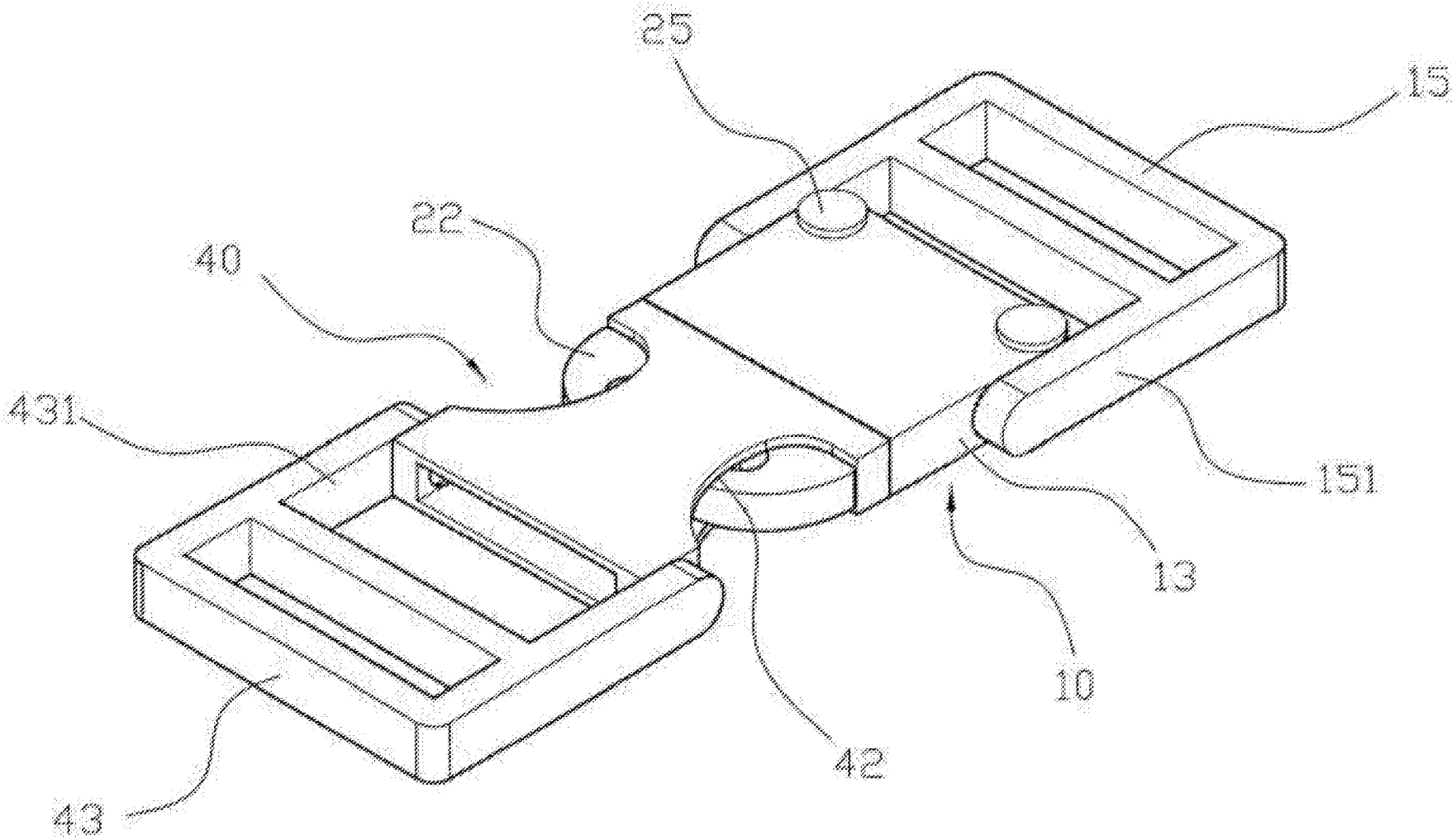
FIG. 1 is a perspective view showing the assembly of a buckle structure according to a preferred embodiment of the present invention.
Figure 2:
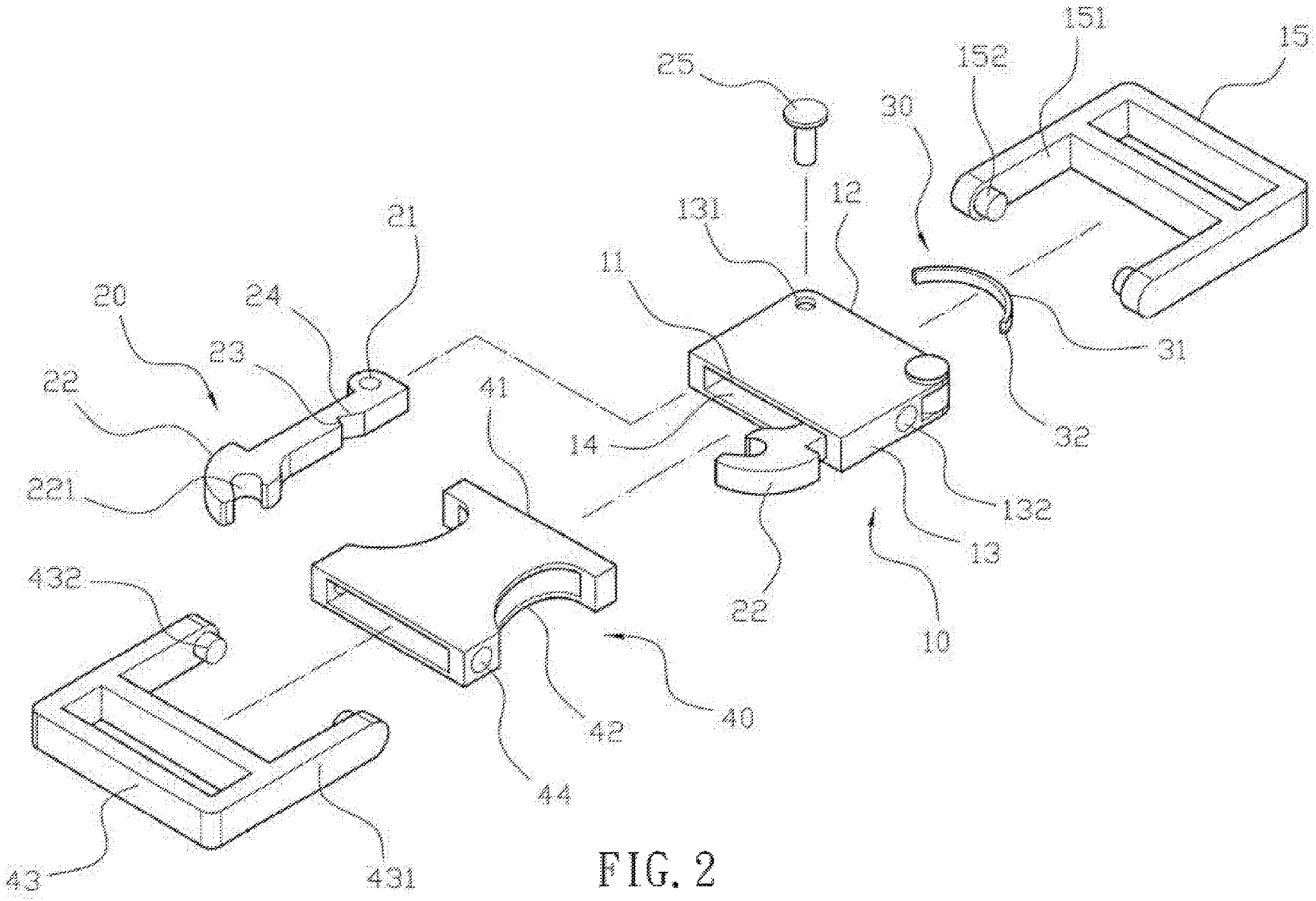
FIG. 2 is a perspective view showing the exploded components of the buckle structure according to the preferred embodiment of the present invention.
Figure 4:
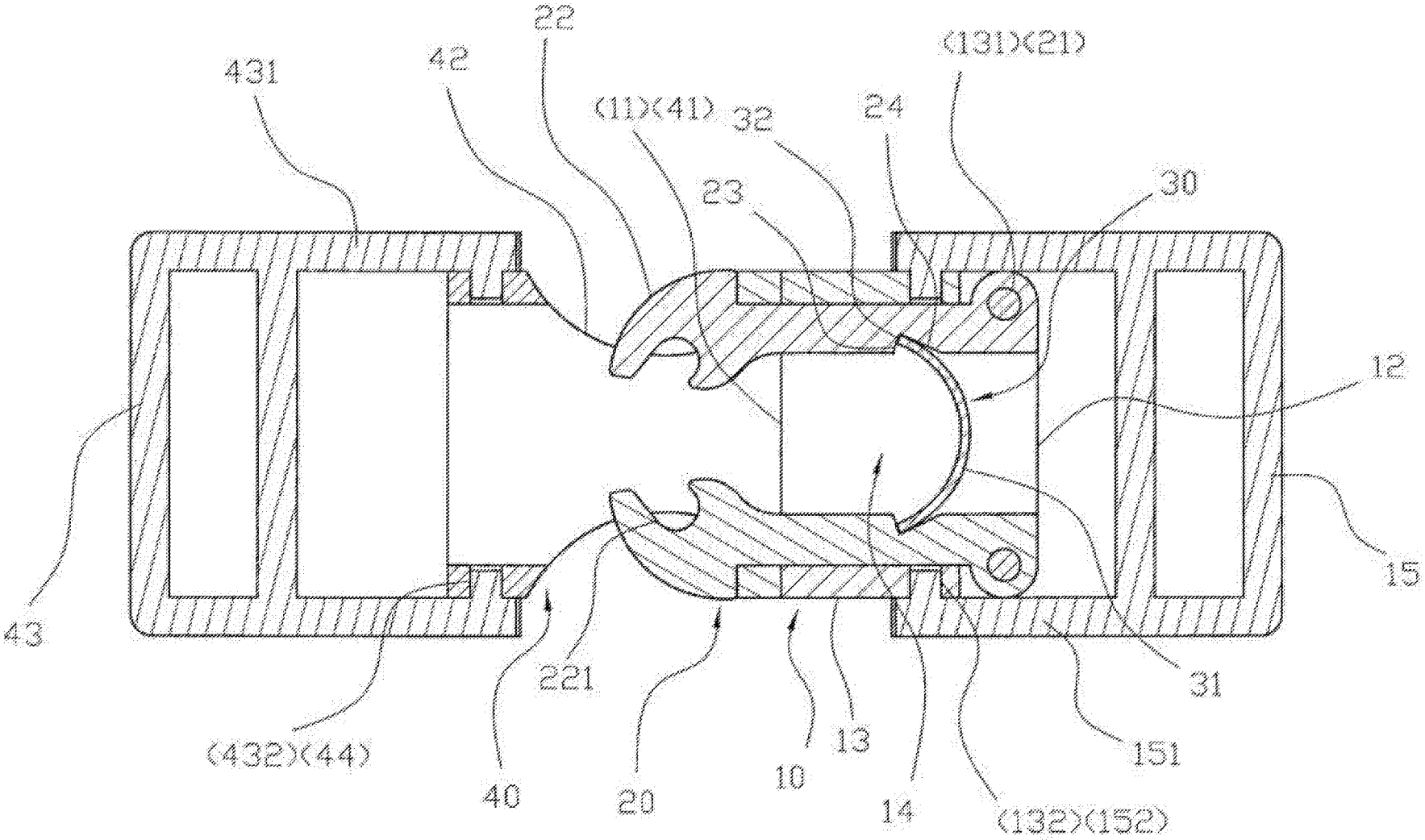
FIG. 4 is another cross sectional view showing the operation of the buckle structure according to the preferred embodiment of the present invention.
Figure 5:
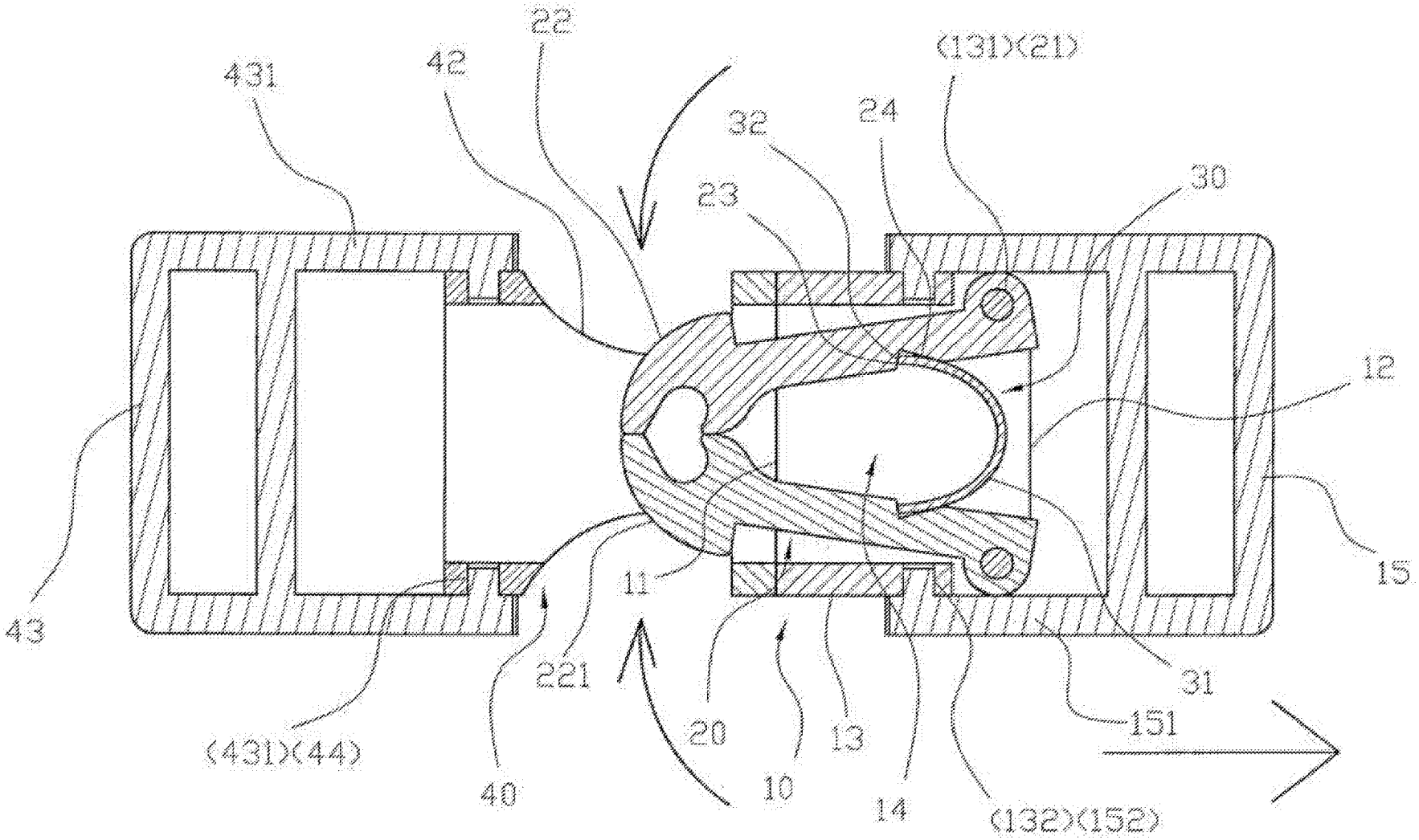
FIG. 5 is also another cross sectional view showing the operation of the buckle structure according to the preferred embodiment of the present invention.

With reference to FIGS. 1-2 and 4, a buckle structure according to a preferred embodiment of the present invention comprises: a male buckle 10, two fastening arms 20, a resilient sheet 30, and a female buckle 40.

The male buckle 10 includes a first opening 11 defined on a first end thereof, a second opening 12 formed on a second end of the male buckle 10 opposite to the first opening 11, an external fence 13 formed on an outer surface of the male buckle 10, and an accommodation cavity 14 defined between and communicating with the first opening 11 and the second opening 12, wherein the external fence 13 has two first orifices 131 formed on a top thereof. The male buckle 10 is rotatably connected with a first connection member 15 and is extruded from aluminum so as to enhance rigidity, and the male buckle 10 is electroplated so as to enhance corrosion resistance and color diversity.

Figure 3:
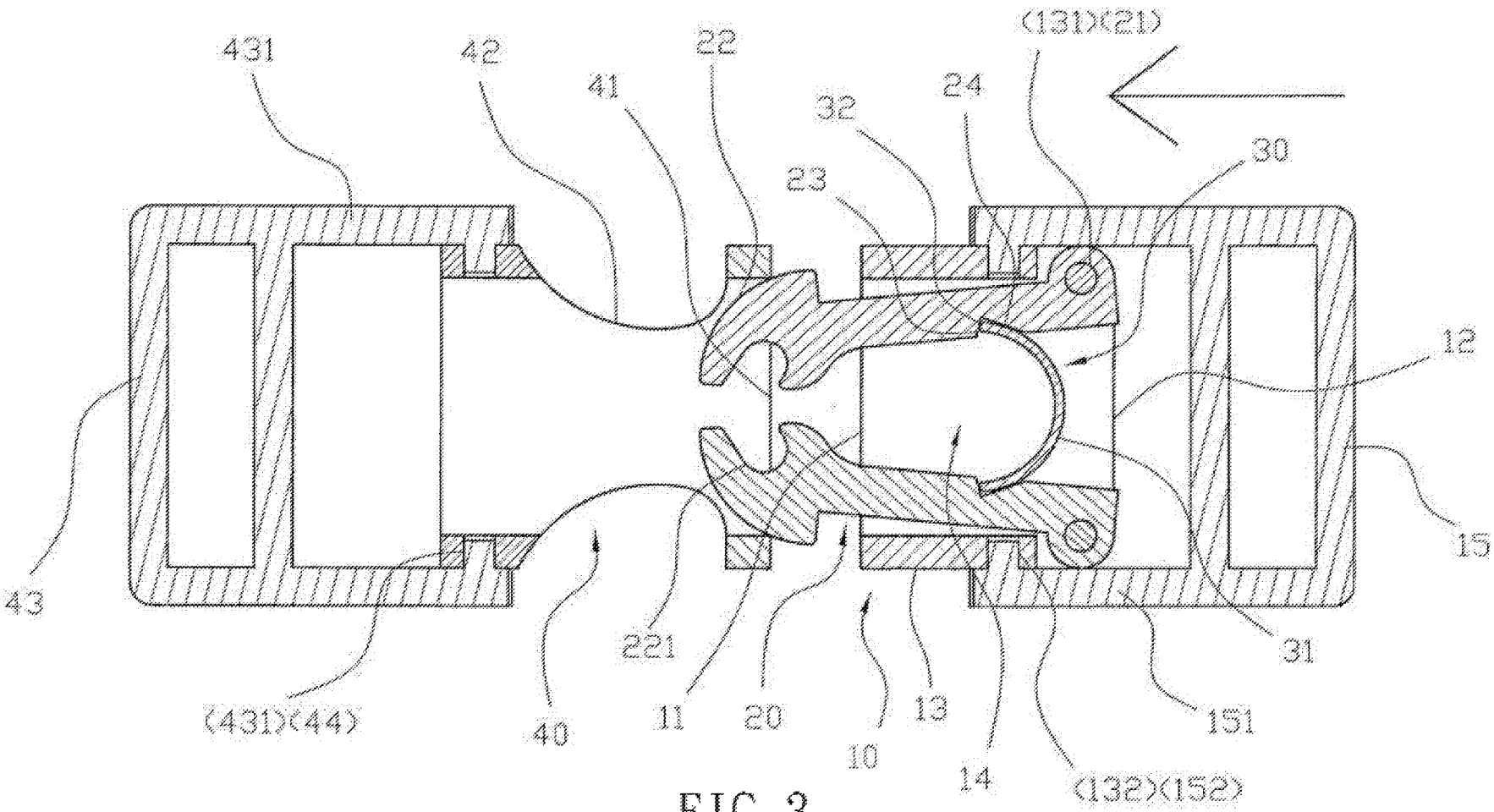
FIG. 3 is a cross sectional view showing the operation of the buckle structure according to the preferred embodiment of the present invention.
Figure 7:
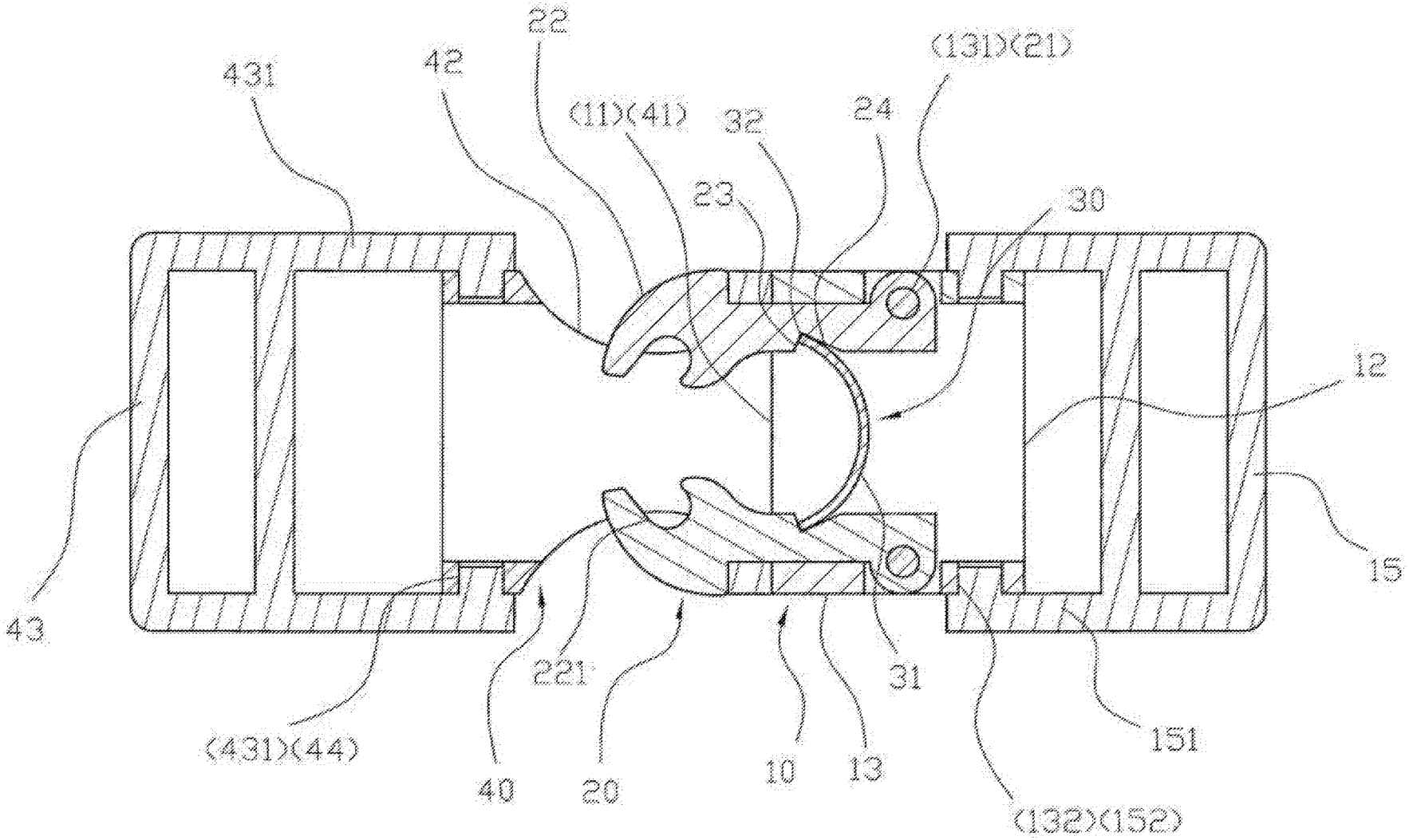
FIG. 7 is still another cross sectional view showing the operation of the buckle structure according to the preferred embodiment of the present invention.

The male buckle 10 further includes two second orifices 132 symmetrically arranged on two sides of the external fence 13 respectively, and the first connection member 15 has two first support extensions 151 and two first rotary shafts 152 extending inward from inner walls of the two first support extensions 151 individually, wherein the first connection member 15 is connected with the body 10 by inserting the two first rotary shafts 151 into the two second orifices 132 respectively. Referring to FIG. 3, the two first orifices 131 of the male buckle 10 are formed proximate to the second opening 12, and the two second orifices 132 are arranged close to the first opening 11. As shown in FIG. 7, in another preferred embodiment, the two second orifices 132 of the male buckle 10 are arranged close to the second opening 12, and the two first orifices 131 are formed proximate to the first opening 11.

The two fastening arms 20 include two through hole 21 formed on two first ends thereof respectively, two engagement portions 22 arranged on two second end of the two fastening arms 20 individually, two first abutting faces 23 and two second abutting faces 24 which are respectively formed on two middle sections of the two fastening arms 20 in a V shape, two columns 25 rotatably connected with the two first orifices 131 and the two through holes 21 individually so that the two first abutting faces 23 and the two second abutting faces 24 of the two fastening arms 20 are located in the accommodation cavity 14 of the male buckle 10, the two engagement portions 22 of the two fastening arms 20 extend out of the first opening 11 of the male buckle 10, and each of the two engagement portions 22 has a notch 221 defined on an inner side thereof, such that when the two fastening arms 20 are partially accommodated in the accommodation cavity 14, two notches 221 of the two fastening arms 20 face each other.

The resilient sheet 30 is formed in a U shape, and the resilient sheet 30 includes a convex arc face 31 and two contacting segments 32 arranged on two ends of the resilient sheet 30 respectively. When the resilient sheet 30 is accommodated in the accommodation cavity 14 of the male buckle 10, the two contacting segments 32 are biased against the two first abutting faces 23 of the two fastening arms 20 separately, the convex arc face 31 abuts against the two second abutting faces 24 of the two fastening arms 20, and the convex arc face 31 faces the second opening 12 of the male buckle 10.

Figure 6:
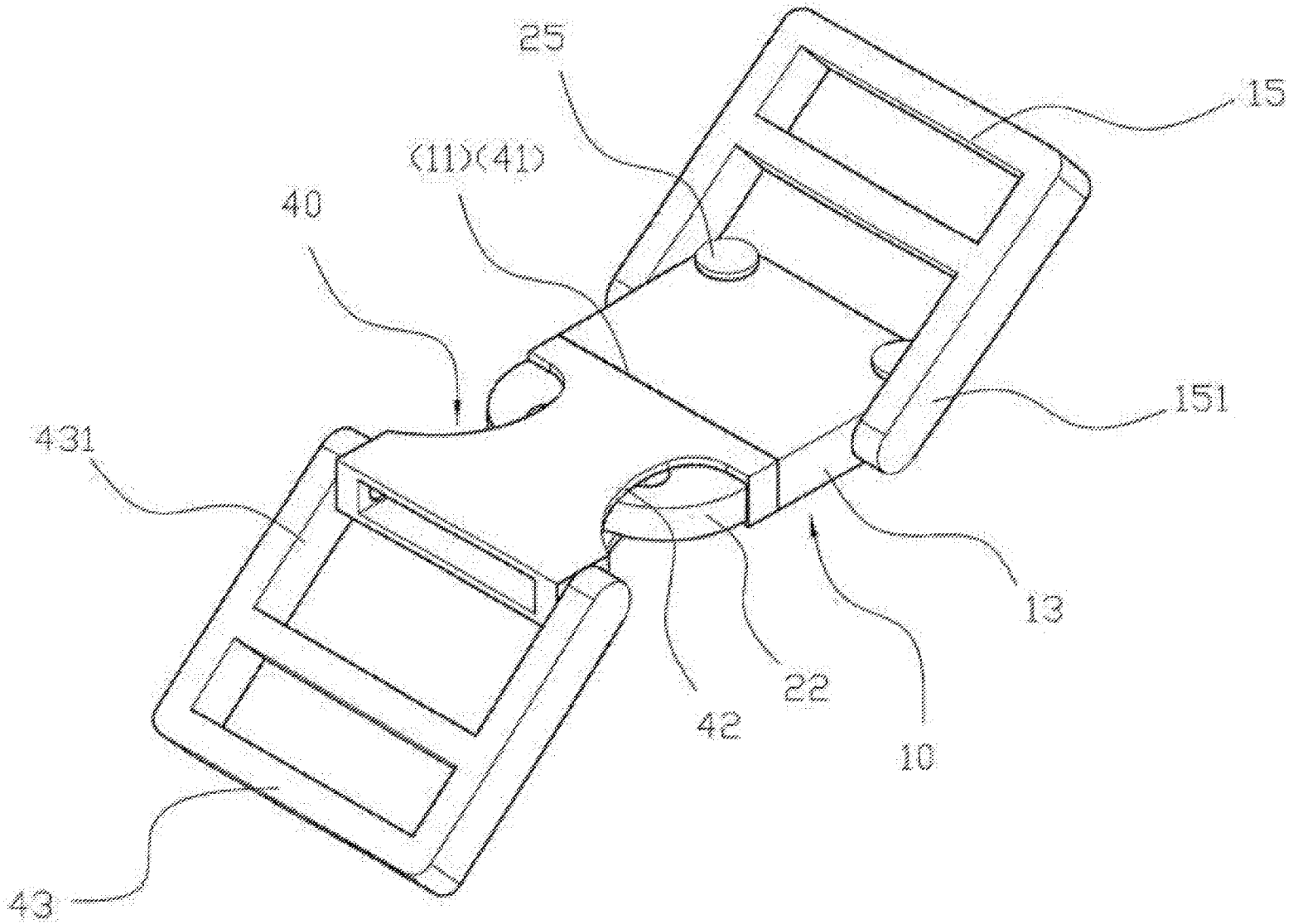
FIG. 6 is a perspective view showing the operation of the buckle structure according to the preferred embodiment of the present invention.
Figure 8:
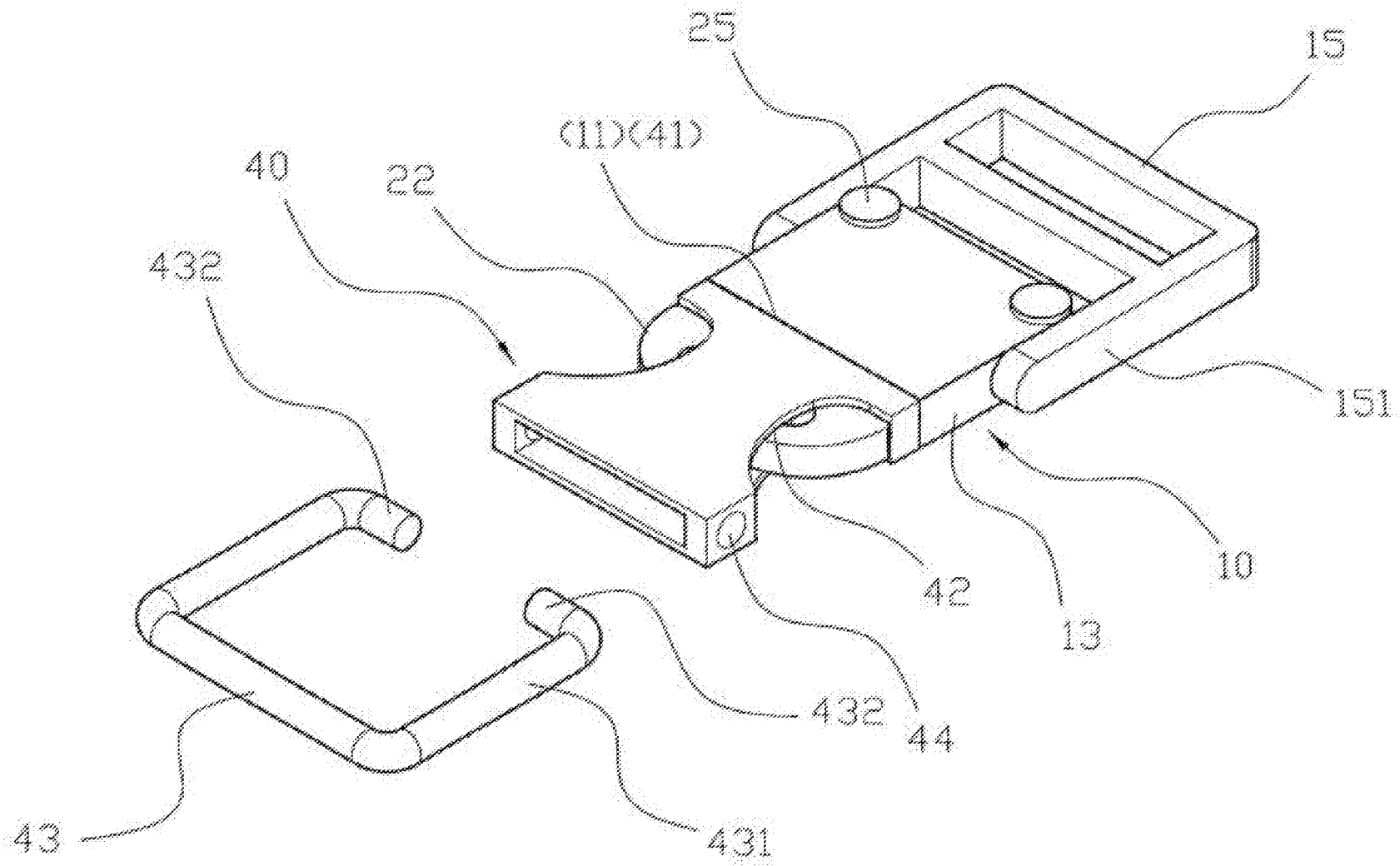
FIG. 8 is a perspective view showing the exploded components of a buckle structure according to another preferred embodiment of the present invention.

The female buckle 40 includes a first aperture 41 defined on a first end thereof, and the female buckle 40 includes two second apertures 42 formed on two sides thereof individually and communicating with the first aperture 41, such that when the male buckle 10 is inserted into the first aperture 41 of the female buckle 40 by ways of the two fastening arms 20 and the two engagement portions 22 engage with the two second apertures 42 individually. A second end of the female buckle 40 away from the first aperture 41 is rotatably connected with a second connection member 43, and the second connection member 43 is made of plastic material or metal material, as illustrated in FIGS. 6 and 8. The female buckle 40 includes two third apertures 44 defined on two sides thereof respectively and located adjacent to the second end of the female buckle 40. The second connection member 43 has two second support extensions 431 and two second rotary shafts 432 extending inward from inner walls of the two second support extensions 431 individually, wherein the second connection member 43 is connected with the female buckle 40 by rotatably inserting the two second rotary shafts 432 in the two third apertures 44 respectively.

In operation, as shown in FIGS. 1-5, the two fastening arms 20 press the resilient sheet 30 so that the two contacting segments 32 of the resilient sheet 30 are biased against the two first abutting faces 23 of the two fastening arms 20 respectively, and the convex arc face 31 of the resilient sheet 30 abuts against the two second abutting faces 24. First ends of the two fastening arms 20 are inserted into the body 10 from the first opening 11 so that the two fastening arms 20 retain with the resilient sheet 30 and press the resilient sheet 30 in the accommodation cavity 14, and the resilient sheet 30 pushes the two fastening arms 20 outwardly so that the two through holes 21 of the two fastening arms 20 align with the two first orifices 131 individually. The two columns 25 are rotatably connected with the two first orifices 131 of the male buckle 10 and the two through holes 21 of the two fastening arms 20 individually, in the meantime, the two engagement portions 22 of the two fastening arms 20 extend out of the first opening 11, and the two first abutting faces 23 and the two second abutting faces 24 of the two fastening arms 20 are located in the accommodation cavity 14 of the male buckle 10. Thereafter, the two first rotary shafts 152 of the first connection member 15 are rotatably inserted into the two second orifices 132 of the buckle 10 respectively, the two second rotary shafts 432 of the second connection member 43 are rotatably inserted into the two third apertures 44 of the female buckle 40 respectively. The first connection member 15 and the second connection member 43 are coupled with a coupling strap (not shown) so that the first connection member 15 and the second connection member 43 are fastened via the coupling strap.

The male buckle 10 is inserted into the first aperture 41 of the female buckle 40 by way of the two engagement portions 22 of the two fastening arms 20 so that the two engagement portions 22 press the resilient sheet 30, and when the two engagement portions 22 are located in the two second apertures 42 of the female buckle 40 individually, the resilient sheet 30 pushes the two engagement portions 22 to retain with the two second apertures 42 respectively, thus fastening the male buckle 10 with the female buckle 40.

As desiring to unfasten the male buckle 10 from the female buckle 40, the two engagement portions 22 of the two fastening arms 20 are manually pressed by user so that the two fastening arms 20 contact with each other and press the resilient sheet 30, thus removing the two fastening arms 20.

Referring to FIG. 6, the male buckle 10 includes the two second orifices 132 symmetrically arranged on the two sides of the external fence 13 respectively, and the two first rotary shafts 152 of the first connection member 15 are rotatably inserted into the two second orifices 132 of the male buckle 10 respectively, hence the first connection member 15 rotates along the two second orifices 132 by using the two first rotary shafts 152. The two second rotary shafts 432 of the second connection member 43 are rotatably inserted into the two third apertures 44 of the female buckle 40 respectively so that the female buckle 40 is rotated to a desired angle by way of the second connection member 43, thus fastening the male buckle 10 with the female buckle 40 easily.

Figure 9:
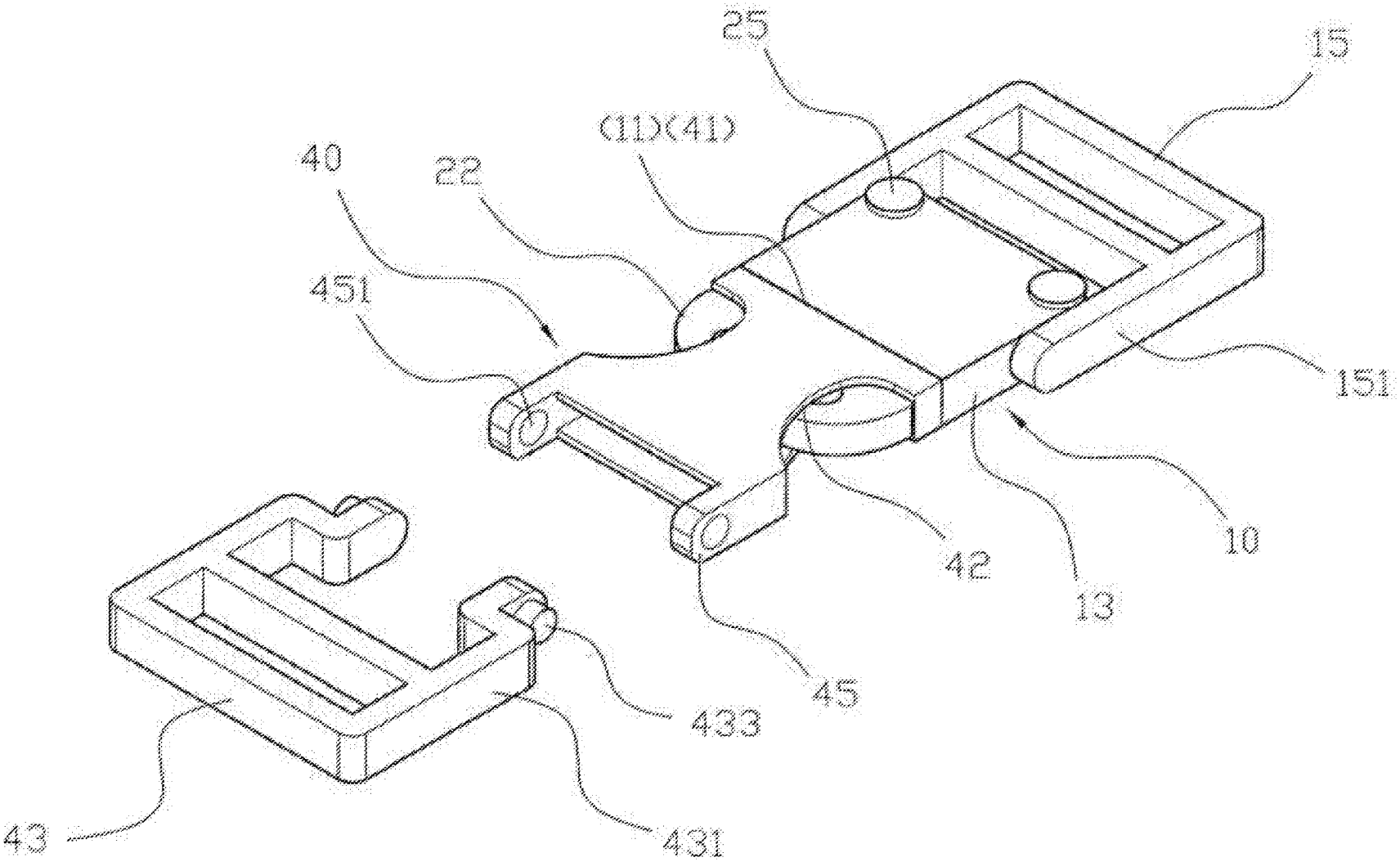
FIG. 9 is a perspective view showing the exploded components of a buckle structure according to another preferred embodiment of the present invention.
Figure 10:
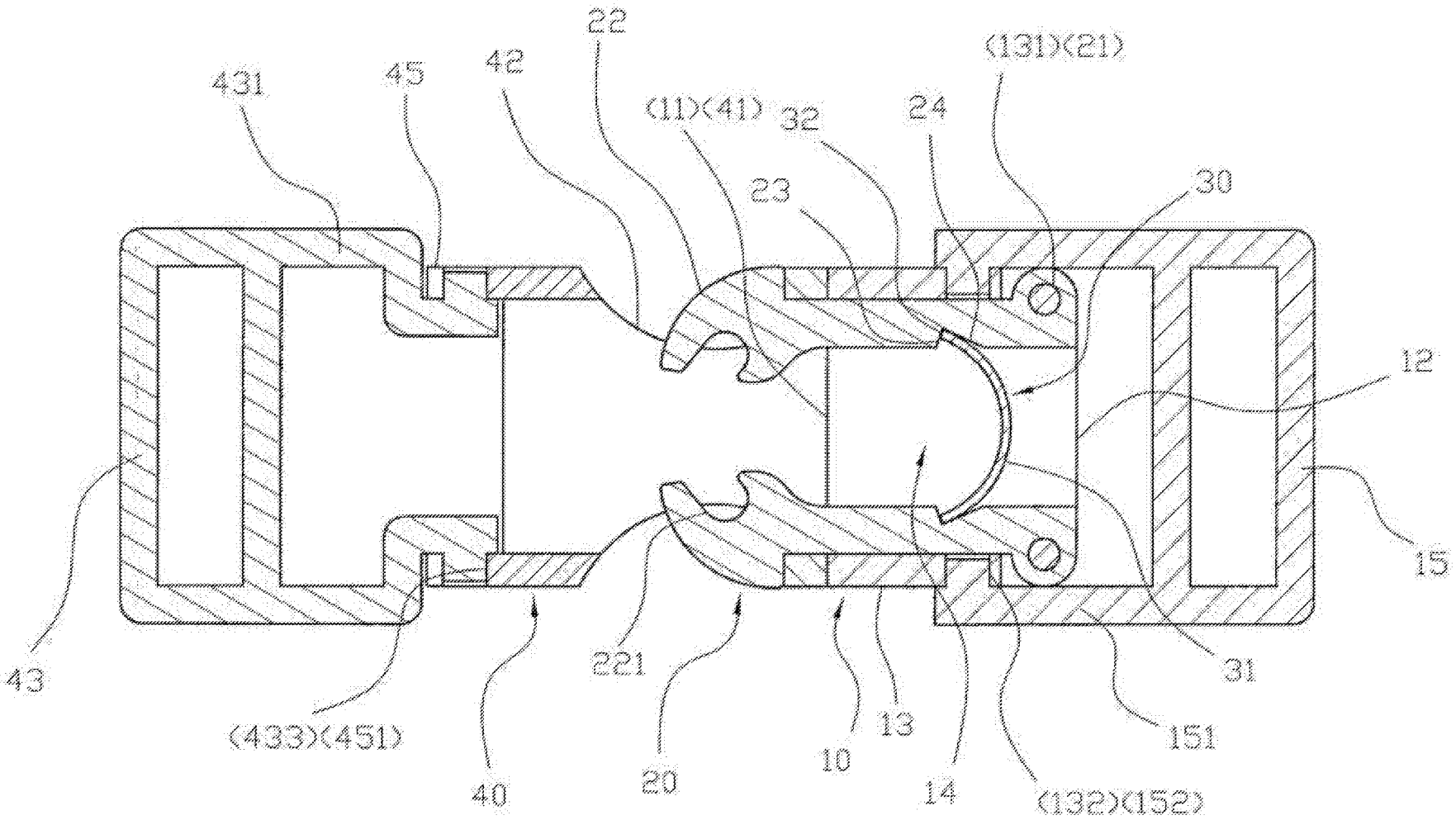
FIG. 10 is a cross sectional view showing the operation of the buckle structure according to said another preferred embodiment of the present invention.

In another preferred embodiment, as shown in FIGS. 9 and 10, the female buckle 40 includes two rotatable coupling portions 45 extending outward from the second end thereof away from the first aperture 41, and the two rotatable coupling portions 45 have two passing apertures 451 defined thereon individually. The second connection member 43 has two second support extensions 431 and two coupling rods 433 extending outward from outer walls of the two second support extensions 431 individually, wherein the second connection member 43 is connected with the female buckle 40 by rotatably inserting the two coupling rods 433 in the two passing apertures 451 respectively, hence the female buckle 40 is rotated to a desired angle by way of the second connection member 43, thus fastening the male buckle 10 with the female buckle 40 easily.

Figure 11:
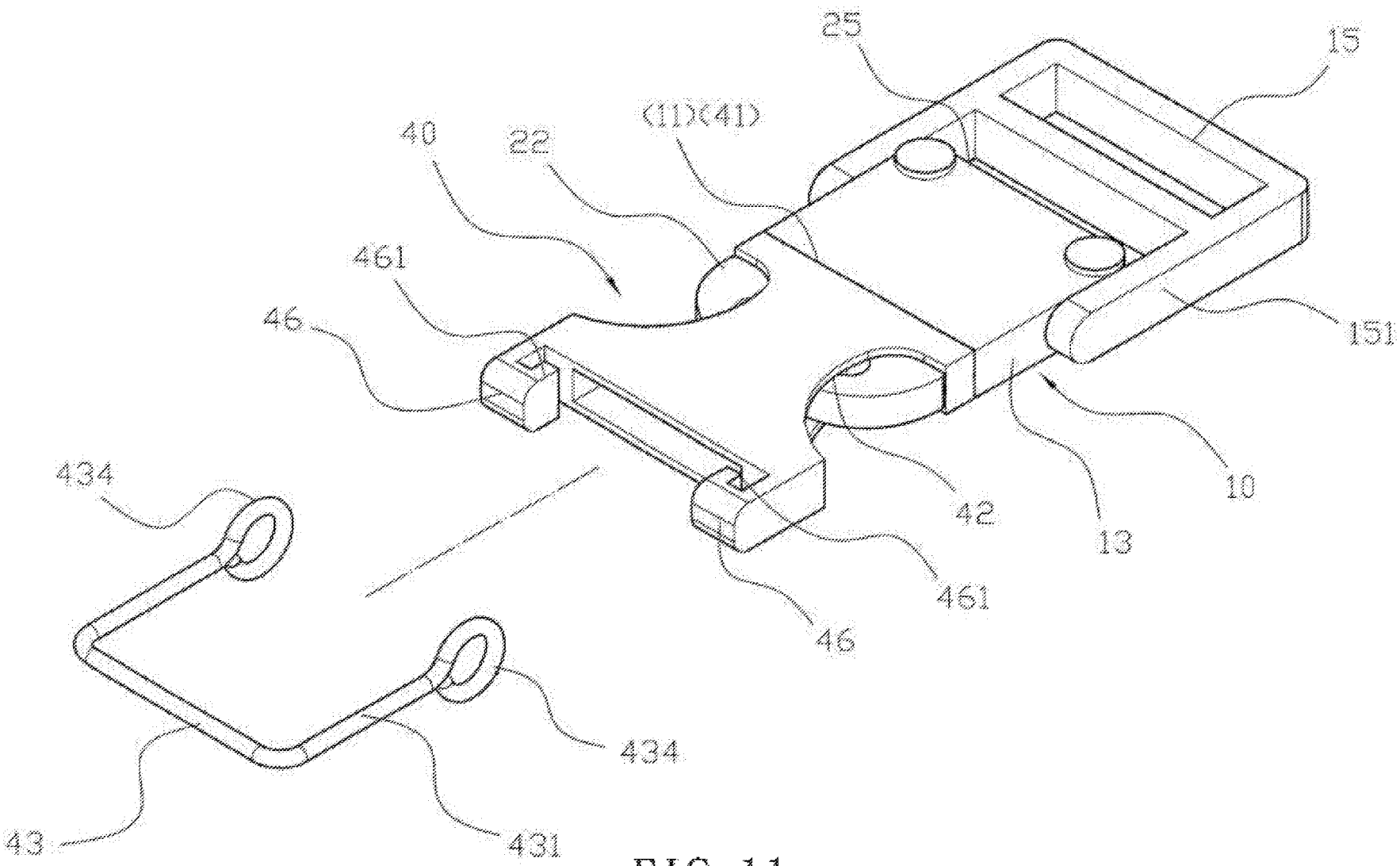
FIG. 11 is a perspective view showing the exploded components of a buckle structure according to another preferred embodiment of the present invention.
Figure 12:
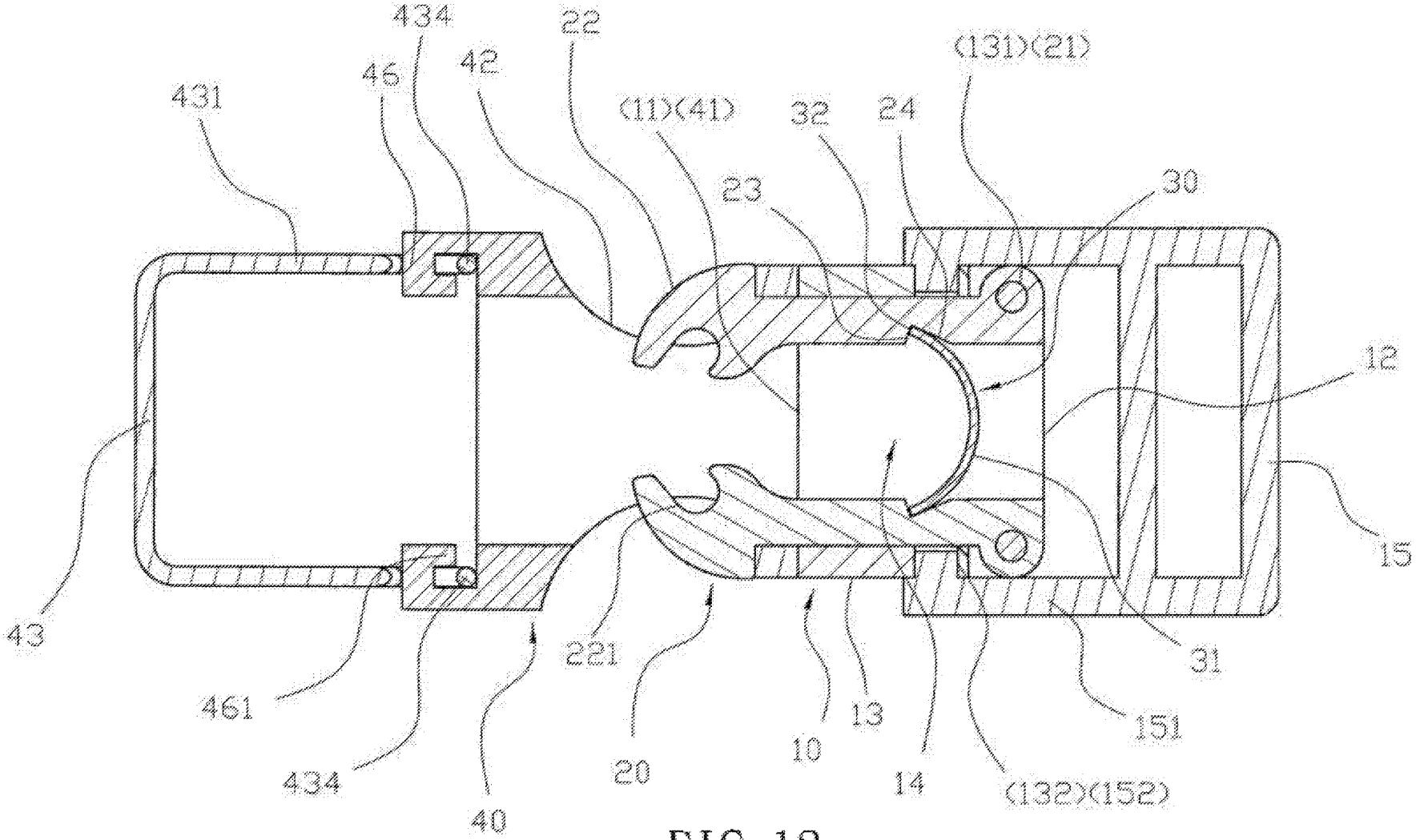
FIG. 12 is a cross sectional view showing the operation of the buckle structure according to said another preferred embodiment of the present invention.
Figure 13:
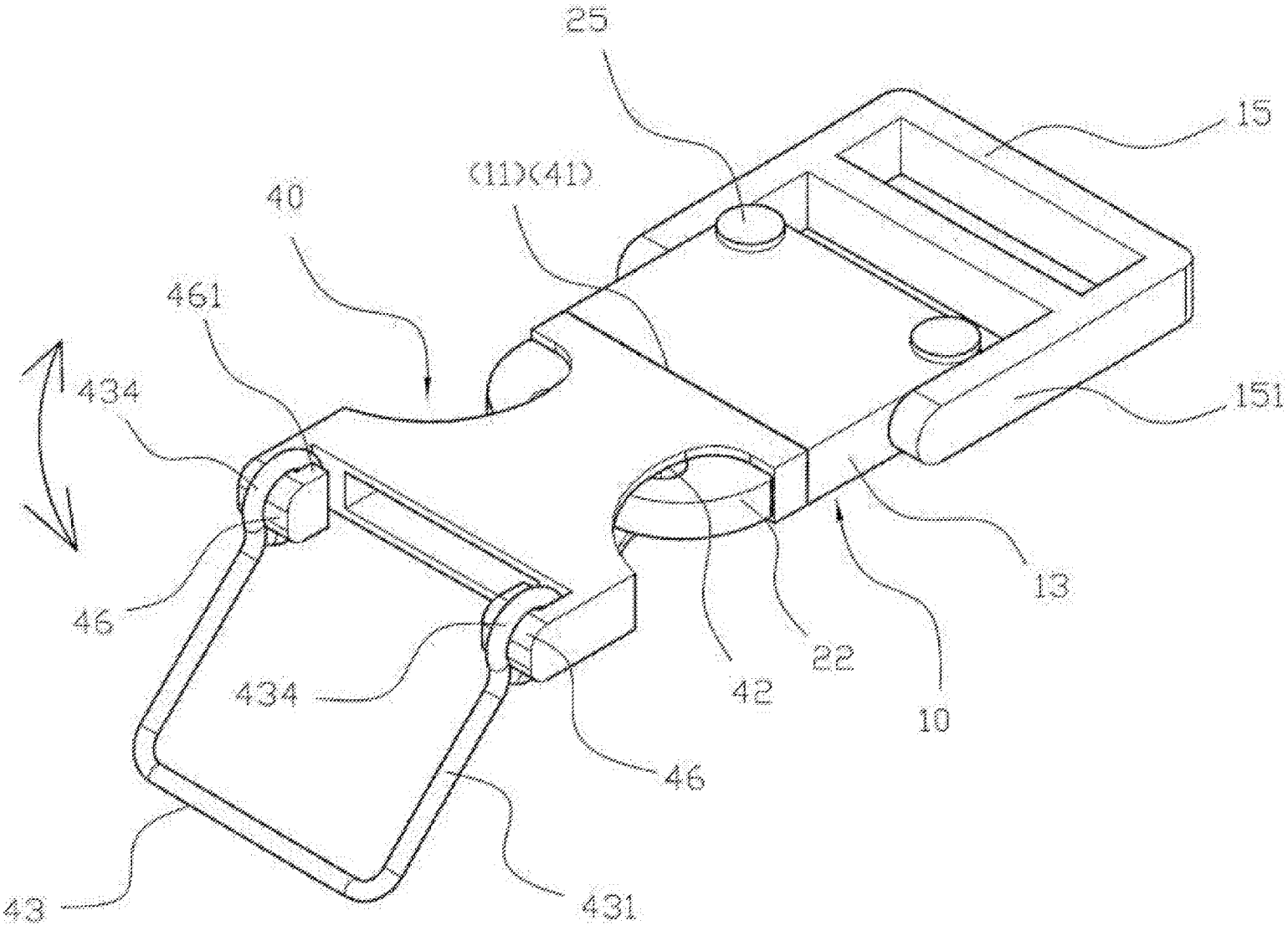
FIG. 13 is a perspective view showing the operation of the buckle structure according to said another preferred embodiment of the present invention.

With reference to FIGS. 11-13, in another preferred embodiment, the female buckle 40 includes two hooks 46 extending inward from the second end thereof respectively, and the two hooks 46 have two shoulders 461 formed on inner walls of the two hooks 46 individually. The second connection member 43 has two rings 434 formed on two ends thereof individually and configured to hook with the two hooks 46 of the female buckle 40 respectively, wherein the two shoulders 461 stop the two rings 434 respectively so as to control an adjustable angle of the second connection member 43, hence the male buckle 10 is rotatably fastened with the female buckle 40.

Thereby, the buckle structure of the present invention has advantages as follows:

1. The two fastening arms 20 press the resilient sheet 30 so that the two contacting segments 32 of the resilient sheet 30 are biased against the two first abutting faces 23 of the two fastening arms 20 respectively, and the convex arc face 31 of the resilient sheet 30 abuts against the two second abutting faces 24. The first ends of the two fastening arms 20 are inserted into the body 10 from the first opening 11 so that the two fastening arms 20 retain with the resilient sheet 30 and press the resilient sheet 30 in the accommodation cavity 14, and the resilient sheet 30 pushes the two fastening arms 20 outwardly so that the two through holes 21 of the two fastening arms 20 align with the two first orifices 131 individually, thus connecting the two fastening arms 20 with the body 10 easily.

2. The two first orifices 131 of the male buckle 10 are rotatably connected with the two fastening arms 20, the two contacting segments 32 of the resilient sheet 30 are biased against the two first abutting faces 23 of the two fastening arms 20 respectively, and the convex arc face 31 abuts against the two second abutting faces 24, hence the two fastening arms 20 expend in the accommodation cavity 14 of the body 10, and the resilient sheet 30 is retained by the two first abutting faces 23 and the two second abutting faces 24 securely.

3. The male buckle 10 includes the two second orifices 132 symmetrically arranged on the two sides of the external fence 13 respectively, and the two first rotary shafts 152 of the first connection member 15 are rotatably inserted into the two second orifices 132 of the buckle 10 respectively, hence the first connection member 15 rotates along the two second orifices 132 by using the two first rotary shafts 152. Furthermore, the female buckle 40 is rotated to the desired angle by way of the second connection member 43, thus fastening the male buckle 10 with the female buckle 40 easily.

While the first embodiments of the invention have been set forth for the purpose of disclosure, modifications of the disclosed embodiments of the invention as well as other embodiments thereof may occur to those skilled in the art. The scope of the claims should not be limited by the first embodiments set forth in the examples, but should be given the broadest interpretation consistent with the description as a whole.

What is claimed is:

1. A buckle structure comprising:

a male buckle including a first opening defined on a first end of the male buckle, a second opening formed on a second end of the male buckle opposite to the first opening, an external fence formed on an outer surface of the male buckle, and an accommodation cavity defined between and communicating with the first opening and the second opening, wherein the external fence has two first orifices formed on a top thereof;

two fastening arms including two through holes, two engagement portions, two first abutting faces, two second abutting faces, and two columns, the two engagement portions of the two fastening arms extend out of the first opening of the male buckle; and a resilient sheet formed in a U-shape, and the resilient sheet including a convex arc face and two contacting segments arranged on two ends of the resilient sheet respectively;

wherein a respective first end of each of the respective fastening arms has a respective one of the two through holes passing there through, and a respective second end of the respective fastening arms has a respective one of the two engagement portions formed thereon, wherein a respective middle section of each of the respective fastening arms has a respective one of the two first abutting faces and a respective one of the two second abutting faces formed thereon, said fastening arms forming a V-shape, and a respective single column is rotatably connected with a respective first orifice of the two first orifices and the respective one of the two through holes so that the first abutting faces and the second abutting faces are located in the accommodation cavity of the male buckle;

wherein when the resilient sheet is accommodated in the accommodation cavity of the male buckle, the two contacting segments are biased against the two first abutting faces of the two fastening arms separately, the convex arc face abuts against the two second abutting faces of the two fastening arms, and the convex arc face faces the second opening of the male buckle.

2. The buckle structure as claimed in claim 1, wherein the male buckle is rotatably connected with a first connection member, and the male buckle further includes two second orifices symmetrically arranged on two sides of the external fence respectively, and the first connection member has two first support extensions and two first rotary shafts extending inward from inner walls of the two first support extensions individually, wherein the first connection member is connected with a body of the male buckle by inserting a respective one of the two first rotary shafts into a respective one of the two second orifices.

3. The buckle structure as claimed in claim 2, wherein the two first orifices of the male buckle are formed proximate to the second opening, and the two second orifices are arranged close to the first opening.

4. The buckle structure as claimed in claim 2, wherein the two second orifices of the male buckle are arranged close to the second opening, and the two first orifices are formed proximate to the first opening.

5. The buckle structure as claimed in claim 2, wherein the male buckle is extruded from aluminum and is electroplated.

6. The buckle structure as claimed in claim 1 further comprising a female buckle, and the female buckle including a first aperture defined on a first end of the female buckle and two second apertures communicating with the first aperture, wherein a respective one of the two second apertures is formed on a respective side of the female buckle, such that when the male buckle is inserted into the first aperture of the female buckle by ways of the two fastening arms, a respective one of the two engagement portions engages with a respective one of the two second apertures individually.

7. The buckle structure as claimed in claim 6, wherein a second end of the female buckle away from the first aperture is rotatably connected with a second connection member, and the second connection member is made of plastic material or metal material.

8. The buckle structure as claimed in claim 7, wherein the female buckle includes two third apertures located adjacent to the second end of the female buckle, wherein a single one of the third apertures is defined on another respective side of the female buckle, and the second connection member has two second support extensions and two second rotary shafts extending inward from inner walls of the two second support extensions individually, wherein the second connection member is connected with the female buckle by rotatably inserting the two second rotary shafts in the two third apertures respectively.

9. The buckle structure as claimed in claim 7, wherein the female buckle includes two rotatable coupling portions extending outward from the second end of the female buckle away from the first aperture of the female buckle, and the two rotatable coupling portions have two passing apertures defined thereon individually; the second connection member has two second support extensions and two second rotary shafts extending inward from inner walls of the two second support extensions individually, wherein the second connection member is connected with the female buckle by rotatably inserting the two second rotary shafts in the two third apertures respectively.

10. The buckle structure as claimed in claim 7, wherein the female buckle includes two hooks extending inward from the second end thereof respectively, and the two hooks have two shoulders formed on inner walls of the two hooks individually; the second connection member has two rings formed on two ends thereof individually and configured to hook with the two hooks of the female buckle respectively, wherein the two shoulders stop the two rings respectively.

* * * * *